US005429255A

United States Patent [19]

Glynn

[11] Patent Number: 5,429,255

[45] Date of Patent: Jul. 4, 1995

[54] CHILD RESISTANT SAFETY COLLAR PUSH-PULL DISPENSER CLOSURE

[75] Inventor: Kenneth P. Glynn, Raritan Township, Hunterdon County, N.J.

[73] Assignee: Ideal Ideas, Inc., Flemington, N.J.

[21] Appl. No.: 113,178

[22] Filed: Aug. 30, 1993

[51] Int. Cl.[6] ..... B65D 55/02; B67D 3/00

[52] U.S. Cl. ..... 215/223; 215/206; 222/522

[58] Field of Search ..... 215/206, 208, 222, 223, 215/307, 311, 313; 220/724, 727; 222/522, 524, 525

[56] References Cited

U.S. PATENT DOCUMENTS

| | | | |
|---|---|---|---|
| 3,703,974 | 11/1972 | Boxer et al. . | |
| 3,782,578 | 1/1974 | Ballin . | |
| 4,020,981 | 5/1977 | Nixdorff | 222/525 |
| 4,095,718 | 6/1978 | Kong . | |
| 4,361,243 | 11/1982 | Virtanen . | |
| 4,779,747 | 10/1988 | Morel | 215/206 |
| 4,979,648 | 12/1990 | Montgomery et al. | 222/525 X |
| 5,217,130 | 6/1993 | Weinstein | 215/220 |
| 5,316,162 | 5/1994 | Pierson | 215/206 X |

*Primary Examiner*—Stephen J. Castellano
*Assistant Examiner*—Nathan Newhouse
*Attorney, Agent, or Firm*—Kenneth P. Glynn

[57] ABSTRACT

The present invention is a dispenser closure, having a main closure base for attachment to a container, an outer ring and a push-pull dispenser mechanism attached to the base. The main closure base has a top portion with a circular horizontal track thereon for attachment with an outer ring and the outer ring has a corresponding circular inside wall horizonal track. They are connected so as to be freely horizontally rotatable thereabout, but otherwise permanently connected to one another. The outer ring has a top with an inwardly biased ledge for retaining a push-pull sleeve of the push-pull mechanism, and has a downwardly extended aspect to the ledge to retain the sleeve closed, and at least one cut out on the ledge to permit the sleeve to be pulled up to an open position. The sleeve has a circular bottom for inserting into the outer ring and over a push-pull stem of the push-pull mechanism. The bottom of the sleeve has at least one protrusion with a geometry of adequate size to freely move up the cut out of the ledge of the outer ring when aligned therewith.

15 Claims, 1 Drawing Sheet

FIG. 1
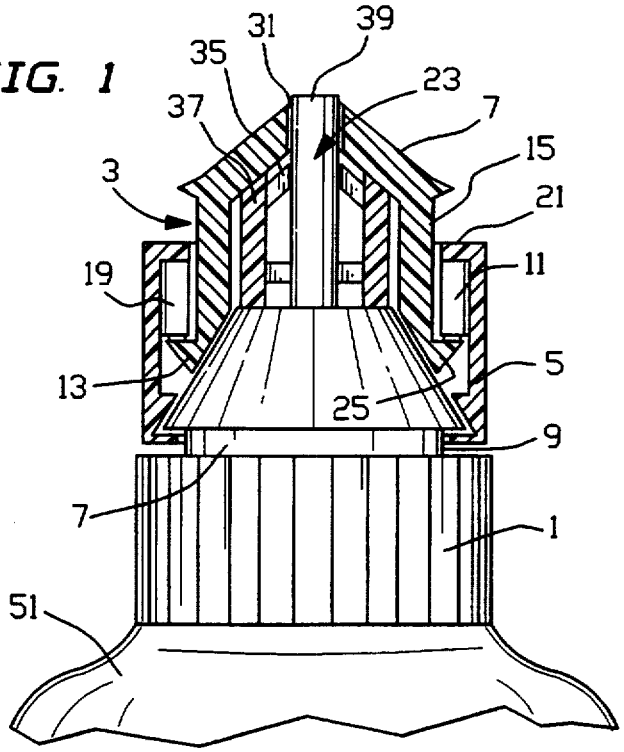
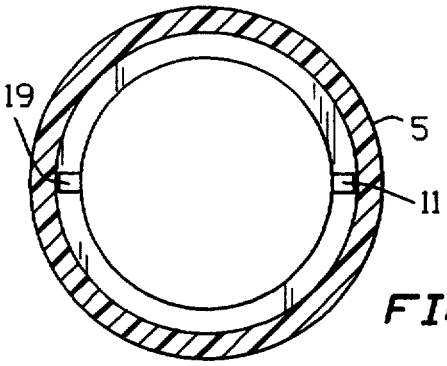
FIG. 2
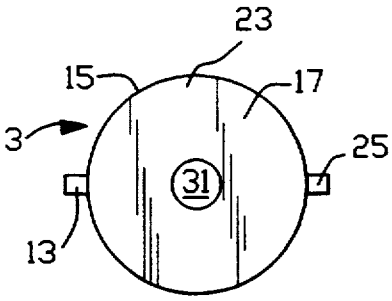
FIG. 3
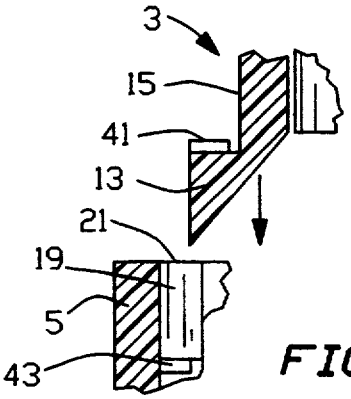
FIG. 4
FIG. 5
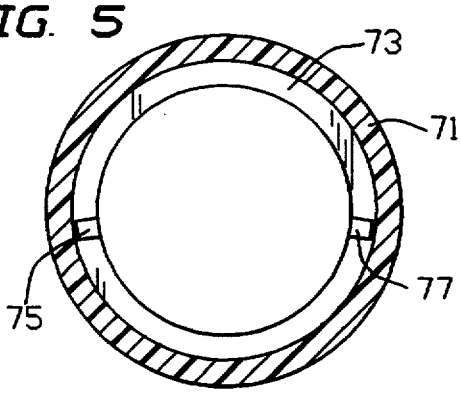

CHILD RESISTANT SAFETY COLLAR PUSH-PULL DISPENSER CLOSURE

BACKGROUND OF THE INVENTION

1. Field of the Invention

The present invention relates to child resistant caps, and more particularly to overcaps with safety rings for push-pull dispensers.

2. Information Disclosure Statement

Safety caps have been well known for at least three decades and literally come in many hundreds of shapes and forms with diverse mechanisms for achieving safety. The objective of such devices is to slow down or prevent the opening of a dispenser by a child to ultimately reduce or prevent use of a medication or dangerous or hazardous material by a young child who may unwittingly consume some of the contents and suffer severe consequences. The following patents represent four variations on safety caps which exemplify the art:

U.S. Pat. No. 3,703,974 to Leo Boxer and Robert Boxer describes a safety cap and container combination wherein the container mouth includes a plurality of spaced ribs or flanges, each having a differently located, notched out passageway over which a cap member having at least one projecting internal lug is positioned in a single movement to close the container. In one form of the invention, a bead at the rim of the container mouth may be provided to mate with an internal groove in the cap member to seal tightly the cap member to the container. In order to remove the cap member, it is moved partially away from the container to disengage the bead from the groove and the lug member is then positioned and aligned with each slot and advanced therethrough in successive fashion to open the mouth of the container.

U.S. Pat. No. 3,782,578 to Gene Ballin sets forth a novel disposable closure. The device includes an opener for opening a closure cap along a score line around the base of an annular channel without piercing the cap. It includes a collar which rotatably and slidably engages the cap and includes a peripheral wall provided with circumferentially spaced depending arcuate teeth of greater thickness than the channel and stop elements which limit the downward movement of the device on the cap. The device is pressed downwardly and rotated so that the teeth wedge between and spread the channel walls to sever the closure along the full length of the score line. The piercing of the channel by the teeth is prevented by the stop elements.

U.S. Pat. No. 4,095,718 to Cheung Tung Kong describes a convertible safety cap. A cap is provided for closing a container having a locking portion for use in a precautionary arrangement to prevent children from obtaining access into the container. The cap is convertible so as to cooperate with such a container to provide not only such a precautionary arrangement but also an alternative easy opening arrangement. The invention includes a cap, an annular disk and a locking rim with notches through which tabs on the cap may pass.

U.S. Pat. No. 4,361,243 to Risto Virtinen describes a closing means for a container, tube or the like. This device is a closing means for a nozzle which is fixably mounting on a container or for a tube or the like. The closing means is openable when turned into a predetermined position which is indicated by indicators provided on the closing means and on the container. It is setable diametrically opposite to each other, and characterized in that the lower rim of the closing means or the upper rim of the container is provided with a separate background ring extending at least partially behind the indicator of the closing means and the indicator of the container.

Notwithstanding the significant prior art in this field, it is believed that the present invention, which utilizes a safety collar (outer ring) in the particular fashion described herein, is neither taught nor rendered obvious.

SUMMARY OF THE INVENTION

The present invention is a dispenser closure. It includes a main closure base for attachment to a container, an outer ring and a push-pull dispenser mechanism attached to the base. The main closure base has a top portion with a circular horizontal track thereon for attachment with an outer ring. The outer ring has a circular inside wall with a horizonal track thereon for attachment to the track of the base so as to connect them in such a way as to be freely horizontally rotatable thereabout, but otherwise permanently connected to one another. The outer ring has a top with an inwardly biased ledge for retaining a push-pull sleeve of a push-pull mechanism. The outer ring has a downwardly extended aspect to the ledge to generally retain the sleeve closed and at least one cut out on the ledge to permit the sleeve to be pulled up to an open position. The sleeve of the push-pull mechanism has a circular bottom adapted to be inserted into the outer ring and over a push-pull stem of the push-pull mechanism. The bottom of the sleeve has at least one protrusion which has a geometry of adequate size to freely move up the cut out of the ledge of the outer ring when aligned therewith. When the sleeve has been inserted and is subsequently rotated, it cannot be opened unless the protrusion is aligned with the cut out. In preferred embodiments, the ledge of the outer ring has adequate flexibility to allow the sleeve to be pushed down for easy assembly.

BRIEF DESCRIPTION OF THE DRAWINGS

The present invention will be more fully understood when the specification herein is taken in conjunction with the drawings appended hereto, wherein:

FIG. 1 shows a partial front partially cut view of a present invention dispenser closure;

FIG. 2 shows a cut bottom view of an outer ring used in the closure shown in FIG. 1;

FIG. 3 shows a top view of the push-pull mechanism sleeve used in the closure shown in FIG. 1;

FIG. 4 shows a partial cut side view of a portion of a sleeve and outer ring illustrating details of the closure shown in FIG. 1; and, FIG. 5 shows a cut bottom view of an alternative embodiment outer ring for a present invention closure.

DETAILED DESCRIPTION OF THE INVENTION

FIG. 1 shows a front partially cut, partial view of a present invention dispenser closure. Here, main closure base 1 is shown attached to container 51. This is attached by known conventional means and may include crimping, heat sealing, force fitting, irreversible threading, molded in place as part of a container or any other known means of creating it with or attaching it to a container. Thus, "attachable" as used herein means able to be connected to in a manner that is permanent, or formed as an integral part thereof.

Push-pull mechanism 23 has a sleeve 3 which is shown in its cut view along with outer ring 5. Main closure base 1 includes a base track 7. In this case, it is a horizontal, circular indentation, as shown. Alternatively, it could be an annular protrusion or bead. Outer ring 5 has a track catch 9 which, in this case, is a protrusion which fits into base track 7 and allows outer ring 5 to be freely horizontally rotated about main closure base 1. As an alternative, if base track 7 were a bead protrusion, then outer ring track catch 9 would be an indentation instead of a protrusion. In other words, it is not critical as to whether the base or the outer ring has the male or female portion of the track. In any event, by "track" is meant either an indentation or a protrusion so that a complementary component rides the track. This is similar to tracks for a subway which may be protruding from the ground such as in the underground section or indented into the roadway such as above ground tracking.

Referring both to FIGS. 1 and 2, with FIG. 2 showing a bottom cut view of outer ring 5, outer ring 5 has a ledge 21 with cut outs 11 and 19. Extending downwardly from ledge 21 and elaborated more with respect to FIG. 4 below, are elevational sections (e.g. ratchets, ridges, etc.) which maintain some friction between sleeve 3 and outer ring 5. Thus, when a user rotates outer ring 5 without touching sleeve 3, sleeve 3 will travel with outer ring 5, in preferred embodiments, so as to maintain non-alignment and eliminate chance of alignment for opening of sleeve 3 upwardly within outer ring 5.

Referring now to FIGS. 1 and 3, sleeve 3 has a top 17 and a side wall 15 which includes protrusions 13 and 25. These are of adequate geometry so as to be able to fit into cut outs 11 and 19 of ledge 21 of outer ring 5. These protrusions 13 and 25 are opposite one another and of the same geometry but could be different in geometry or not directly opposite one another.

Also shown in FIG. 1 is a front view of the inside details of push-pull dispenser mechanism 23. This is of conventional design and includes vertically moveable sleeve 3, inner neck 37, seal annulus 35 and stationary stem 39. When sleeve 3 is down, stem 39 seals orifice 31 and thus mechanism 23 is closed. When sleeve 3 is up, orifice 31 is open and materials may be dispensed therethrough. This is illustrative and the exact internal aspects of the push-pull mechanism may be any functional configuration without exceeding the scope of the present invention. Further, the type of container, its shape, its materials of construction and its contents are not relevant to this invention. The container could be plastic, metal, glass or other material, and could be rigid, flexible, squeeze type or otherwise.

Referring again to FIGS. 1, 2 and 3, outer ring 5 and/or protrusions 13 and 25 have adequate flexibility so that sleeve 3 may be pressed downwardly and, with the flexion of either the protrusion or the outer ring 5, or both, sleeve 3 will snap into place so that the protrusions 13 and 25 end up under ledge 21 in a secure, child resistant fashion. The flexibility will be minimal such that the sleeve 3 cannot then be moved to the upward, open position, except by alignment of protrusions 13 and 25 with the cut outs 11 and 19.

FIG. 4 shows a front cut, partial view of sleeve 3 and outer ring 5 from FIG. 1. Identical parts are identically numbered. Protrusions 43, e.g., downwardly extending bumps or triangular cross-sectioned extensions, are located on the underside of ledge 21 and similar protrusions 41 are located on the top side of protrusion 13. These nest when sleeve 3 is snapped into outer ring 5 and enhance the friction between the sleeve 3 and the outer ring 5. In fact, due to the friction between the sleeve 3 and the outer ring 5, mentioned above, if either only the sleeve 3 or only the outer ring 5 is rotated, the other will rotate with it and the non-alignment feature will be maintained. Thus, in preferred embodiments, a user can only lift sleeve 3 up by first holding outer ring 5 with one hand and rotating sleeve 3 relative thereto with the other hand or vise versa so as to overcome the friction between the two and align the protrusions 13 and 25 with cut outs 11 and 19 for subsequent lifting of the sleeve 3 in the outer ring 5 to provide access to contents for dispensing through the push-pull dispensing mechanism 23.

FIG. 5 shows a cut bottom view of an outer ring 71 which may be used in an alternative embodiment closure of the present invention. Here, ledge 73 has cut outs 75 and 77 which are not directly opposite one another. This further restricts the removal of an overcap therefrom because, when two cut outs are opposite one another, there would be two opportunities or positions upon a 360° rotation, for removal of an overcap, whereas, with the arrangement shown in FIG. 5, only one unique position will allow for proper alignment and removal of an overcap.

Obviously, numerous modifications and variations of the present invention are possible in light of the above teachings. It is therefore understood that within the scope of the appended claims, the invention may be practiced otherwise than as specifically described herein.

What is claimed is:

1. A dispenser closure, which comprises:

(a) a main closure base attachable to a container, said base having a dispensing orifice, a top portion having a circular horizontal track thereon for attachment with an outer ring;

(b) an outer ring having a circular inside wall having a predetermined diameter and having a horizontal track thereon for attachment to the track of said base so as to connect said outer ring to said base so as to be horizontally and freely rotatable thereabout, said outer ring also having a top with an inwardly biased ledge for retaining a sleeve of a push-pull mechanism in a closed position, and having at least one cut out on said ledge to permit a sleeve to be opened by being lifted upwardly within said outer ring;

(c) a push-pull dispensing mechanism internal structure attached to the top of said base so as to receive and be opened and closed with a push-pull sleeve, relative to said container; and, (d) a push-pull dispensing mechanism sleeve having an outermost circular bottom with a predetermined diameter which is less than the predetermined diameter of said circular inside wall of said outer ring, and wherein said outermost circular bottom is adapted to be inserted into said outer ring and over said push-pull dispensing mechanism internal structure, said bottom having at least one outermost protrusion thereon which has a geometry of adequate size to freely move through said at least one cut out of said ledge of said outer ring and when said sleeve is so inserted and rotated, of adequate size and geometry to prevent said sleeve from being moved upwardly for opening within said outer ring, except when said at least one protrusion and said at least one cut out are in alignment, said outer ring ledge has an underside and said sleeve at least one outermost protrusion has a top side of said at least one outermost protrusion are in frictional contact with one another when said sleeve is inserted into said outer ring.

2. The dispenser closure of claim 1 wherein said main closure base has means for attachment to a container.

3. The dispenser closure of claim 1 wherein said ledge has two cut-outs thereon.

4. The dispenser closure of claim 3 wherein said cut-outs are directly opposite one another.

5. The dispenser closure of claim 3 wherein said cut-outs are not directly opposite one another.

6. The dispenser closure of claim 1 wherein said frictional contact is such that when one of said outer ring and said sleeve are rotated, the other of said outer ring and said sleeve rotates therewith.

7. The dispenser closure of claim 6 wherein said frictional contact may be overcome manually by holding one of said outer ring and said sleeve and rotating the other of said outer ring and said sleeve.

8. The dispenser closure of claim 1 wherein said underside of said ledge and said top of said at least one protrusion have non-smooth topographies to enhance said frictional contact.

9. The dispenser closure of claim 1 wherein at least one of said outer ring and said outermost protrusions is downwardly flexible so as to permit insertion of said sleeve without alignment of said at least one outermost protrusion and said at least one cut out, and is upwardly inflexible so as to prevent removal of said sleeve from said outer ring.

10. The dispenser closure of claim 9 wherein said main closure base has means for attachment to a container.

11. The dispenser closure of claim 9 wherein said ledge has two cut-outs thereon.

12. The dispenser closure of claim 11 wherein said cut-outs are directly opposite one another.

13. The dispenser closure of claim 11 wherein said cut-outs are not directly opposite one another.

14. The dispenser closure of claim 9 wherein said frictional contact is such that when one of said outer ring and said sleeve are rotated, the other of said outer ring and said sleeve rotates therewith.

15. The dispenser closure of claim 14 wherein said frictional contact may be overcome manually by holding one of said outer ring and said sleeve and rotating the other of said outer ring and said sleeve.

* * * * *